US010501856B2

(12) United States Patent
Proshkin et al.

(10) Patent No.: US 10,501,856 B2
(45) Date of Patent: Dec. 10, 2019

(54) METHOD AND APPARATUS FOR LINING THE CATHODE OF THE ELECTROLYTIC CELL

(71) Applicant: United Company RUSAL Engineering and Technology Centre LLC, g. Krasnoyarsk (RU)

(72) Inventors: Aleksandr Vladimirovich Proshkin, g. Krasnoyarsk (RU); Samuil Yakovlevich Levenson, Novosibirsk (RU); Vitaliy Valer'evich Pingin, g. Krasnoyarsk (RU); Aleksey Vasil'evich Morozov, Novosibirsk (RU)

(73) Assignee: UNITED COMPANY RUSAL ENGINEERING AND TECHNOLOGY CENTRE LLC, Krasnoyarsk (RU)

( * ) Notice: Subject to any disclaimer, the term of this patent is extended or adjusted under 35 U.S.C. 154(b) by 116 days.

(21) Appl. No.: 15/496,901

(22) Filed: Apr. 25, 2017

(65) Prior Publication Data

US 2017/0321337 A1 Nov. 9, 2017

Related U.S. Application Data

(62) Division of application No. 14/437,388, filed as application No. PCT/RU2012/000875 on Oct. 25, 2012, now Pat. No. 9,822,457.

(51) Int. Cl.

| | |
|---|---|
| ***C25C 3/08*** | (2006.01) |
| ***B05C 11/02*** | (2006.01) |
| ***B05C 11/08*** | (2006.01) |

(52) U.S. Cl.
CPC ..... *C25C 3/08* (2013.01); *B05C 11/025* (2013.01); *B05C 11/08* (2013.01)

(58) Field of Classification Search
CPC ..... B05C 11/025; B05C 11/08; C25C 3/08
See application file for complete search history.

(56) References Cited

U.S. PATENT DOCUMENTS

| | | | |
|---|---|---|---|
| 4,184,787 | A | 1/1980 | Uebel |
| 4,536,273 | A | 8/1985 | Seltveit |
| 5,314,599 | A | 5/1994 | Allaire |
| 6,258,224 | B1 | 7/2001 | Mirtchi |

FOREIGN PATENT DOCUMENTS

| | | |
|---|---|---|
| CN | 1928161 | 3/2007 |
| EP | 1127983 | 8/2001 |
| RU | 2296819 | 4/2007 |
| RU | 2385972 | 4/2010 |

*Primary Examiner* — James Sanders
(74) *Attorney, Agent, or Firm* — Hogan Lovells US LLP

(57) ABSTRACT

The invention relates to method and apparatus for lining the cathode of the electrolytic cell. The method comprises filling the cell's shell with powder material, leveling it with a rack, covering the fill material with a dust-proof film, and compaction. Compaction is performed in two stages: preliminary static and final dynamic treatment by consequent movement of static and dynamic work tools of compaction along the longitudinal axis of the cathode of the electrolytic cell through a cushion, which is made of at least 2 layers: a lower layer, which prevents pushing powder material forward in the direction of travel, and an upper layer, which provides for a coupling between the cushion and the static work tool. Static treatment unit of the apparatus is designed in the form of a roller with a drive, connected to a dynamic treatment unit with a vibratory exciter by means of elastic elements.

10 Claims, 7 Drawing Sheets

METHOD AND APPARATUS FOR LINING THE CATHODE OF THE ELECTROLYTIC CELL

CROSS REFERENCE TO RELATED APPLICATION

This application is a divisional of and claims priority to U.S. patent application Ser. No. 14/437,388 filed Oct. 25, 2012, which is a U.S. National Phase under 35 U.S.C. § 371 of International Application PCT/RU2012/000875, filed on Oct. 25, 2012. All publications, patents, patent applications, databases and other references cited in this application, all related applications referenced herein, and all references cited therein, are incorporated by reference in their entirety as if restated here in full and as if each individual publication, patent, patent application, database or other reference were specifically and individually indicated to be incorporated by reference.

FIELD OF INVENTION

The proposed technical solution relates to the field of non-ferrous metallurgy and, in particular, to using unshaped materials for lining the cathode of the electrolytic cell in primary aluminum production.

BACKGROUND

The cathode of the electrolytic cell for primary aluminum production consists of electrically conductive cathode blocks that are thermally insulated from below. There is a layer of barrier refractory materials between the cathode blocks and the thermal insulation; these materials are designed to prevent penetration of fluoride salts and sodium vapors into the thermal insulation layers. The process of infiltration of the liquid phase of components of the bath from the bottom blocks into the refractory materials, as well as their interaction, is a complex phenomenon, which involves both physical and chemical interactions at the liquid melt interface between NaF/Na3AlF6 and refractory materials. The structure of the refractory material is the primary factor in the indicated interaction.

According to Darcy's law, the driving force for penetration of molten fluoride salts into the barrier materials is a pressure gradient along the height of a barrier material.

$$q = -\frac{k}{\mu}\frac{dP}{dx} \tag{1}$$

where: q—volumetric flow rate of molten fluoride salts through the cross section (S), $m^3/(m^2s)$; k—permeability coefficient, $m^2$; dP/dx—pressure gradient along the height of the barrier material, Pa; μ—dynamic viscosity, Pa*s.

Since barrier materials are heterogeneous structures with different pore-size distributions, then, the range of pore sizes can be conventionally divided into three areas. For large pores (greater than 100 microns) the pressure gradient is primarily determined by hydrostatic and gravitational forces. For smaller channel pores, along with the aforementioned forces, capillary forces begin to appear. Due to the potential capillary action energy, the pressure gradient is much higher than that for large pores, and such capillaries are able to rapidly absorb melted fluoride salts. The depth of penetration of molten fluoride salts may be determined by the ratio arising from Poiseuille's law:

$$h = \sqrt{\frac{d\sigma\cos\theta\tau}{4\eta}} \tag{2}$$

where: h—depth of penetration; d—diameter of pores; σ—surface tension; η—melt viscosity.

With a further reduction of pore sizes, there is an increase in the pressure gradient (caused by capillary action), but, on the other hand, the hydraulic resistance to fluid flow is growing much faster; therefore, penetration of fluoride salts through such pores can be neglected.

As it follows from equation (2), the depth of penetration of the fluorinated melt decreases with an increase in melt viscosity, a decrease in surface tension and a decrease in the contact (wetting) angle. The physical and chemical characteristics of the melt, which are part of equation (2), depend on the temperature and composition of the melt.

At the initial stage of the penetration process, the main component in the area under the cathode is NaF. It can be explained by the following reaction taking place within the body of the cathode block during cryolite infiltration:

$$4Na_3AlF_6+12Na+3C=Al_4C_3+24NaF \tag{3}$$

Interaction between pure alumina refractories and sodium fluoride is taking place as per the β-alumina formation reaction:

$$12NaF+34Al_2O_3=3(Na_2O*11_3Al_2O_3)+2Na_3AlF_6 \tag{4}$$

Thus, due to a significantly lower density of the β-alumina reaction product, volumetric changes occur in the lining, causing vertical stresses in the bottom and its possible destruction. When a relatively small amount of SiO2 (~25%) appears in the refractory, in addition to reaction (4), the following formation reaction for nepheline will occur (5):

$$6NaF+2Al_2O_3+3SiO_2=3NaAlSiO_4+Na_3AlF_6 \tag{5}$$

If there is an excess of the refractory material and a small amount of NaF, nepheline reacts with silicon dioxide to form albite, NaAlSi3O8, which will be in the glassy viscous molten state to prevent further movement of the interaction front down to the lower part of the cathode in the electrolytic cell:

$$NaAlSiO_4+2SiO_2=NaAlSi_3O_8 \tag{6}$$

An increase in melt viscosity due to the presence of albite in the reaction zone between the aluminosilicate refractory lining and molten cryolite reduces the likelihood of the penetration of fluoride salts into the lower insulating layers of the pit.

As a result of the further increase in the SiO2 content in the aluminosilicate refractory material (above 47%) β-alumina is not present in the reaction zone, and albite and nepheline are formed by the combination of reactions (5) and (6). At a very high SiO2 content (72%), due to insufficient Al2O3, nepheline formation will be difficult.

Therefore, among a significant number of refractories used in the pit, the most widely used materials are aluminosilicate-containing materials with 28%<Al2O3<34%, their relatively low cost being one of the important factors.

The above shows that barrier materials with thin and serpentine channels, having a dense (particle-to-particle) packing of small-sized particles, are characterized by low gas permeability and, obviously, by slow penetration of molten fluoride salts or products of their reaction into barrier materials. In addition, the presence of a temperature gradient in the direction of the penetration along with the increase in melt viscosity due to the formation of albite, will also slow down the penetration process.

Traditionally, shaped materials, in the form of bricks of different size, are used for lining the cell's cathode; preferably, these are aluminosilicate bricks having low porosity and low gas permeability. However, the permeability of the barrier brickwork is generally defined not by the properties of individual bricks, but mostly by the condition of seams between them. The refractory mortar used for sealing seams (on which brickwork mortar is based) is vulnerable to fluoride salts and aggressive gases due to its high porosity. In addition, water used for preparing brickwork mortar causes, at low temperatures, problems with the assembly of the electrolytic cell and has a negative impact on the durability of thermal insulation materials in the cell's cathode.

Along with shaped barrier materials, there has been considerable experience with using loose powders with different particle size distribution and mineralogical composition; they help produce seamless layers. The process of using unshaped materials, during the process of lining the cell's cathode, compares favorably with the process of using brickwork in terms of lining time and less labor.

A lining method is known, comprising filling the cell's cathode shell with powder material and leveling the material with a rack, wherein the unshaped fill material is used, which reacts with fluoride salts to form a compound which is solid at the operation temperature in the cathode (Seltveit A., Diffusion Barrier for Aluminium Electrolysis Furnaces, U.S. Pat. No. 4,536,273, 1985). Test results, however, did not confirm the viability of this lining method because a high porosity of the un-compacted layer led to a continuous supply of gaseous and liquid components to the thermal insulation.

A lining method is known, comprising filling the cell's cathode shell with powder material, leveling the material with a rack, wherein compaction is performed by regular rollers (L. Forrssblad, *Vibratory Compaction of Soil and Foundations*. Translated from English under editorship of M. P. Kostelov, Transport, 1987, 191 pages.) However, an evaluation of static formation results shows that it does not provide for the desired structure of a lining material: low porosity and small-sized pores.

A method is known for lining, including filling the cell's cathode shell with powder material, leveling the material with a rack, wherein compaction was performed by compactors equipped with a vibratory mechanism (U.S. Pat. No. 4,184,787; E01C 19/38). This leads to a certain increase in packing density but the resulting barrier layer still has a relatively high porosity (up to 25%) and, moreover, it has wave-like defects on the surface.

A lining method is known, comprising filling the cell's cathode shell with powder material, leveling the material with a rack, wherein the compaction of unshaped materials is performed by external vibration of the railway platform, on which the cathode is installed (O. Siljan, O. Junge, B. Trygve, T. Svendsen, K. Thovsen *Experiences with Dry Barrier Powder Materials in Aluminium Electrolysis Cells*—Light Metals, 1998, p. 573-581). The disadvantage of this method is material segregation and particle separation along the layer's height; hence, there is a low degree of resistance to penetration of fluoride salts. This leads to high rates of chemical reactions, which reduces the operation life of the cell.

A method for lining the cell's cathode is known, comprising filling the cell's cathode shell with powder material, leveling the material with a rack, wherein compaction is performed by air ramming from above through hot ramming paste (R. Weibel, *Advantages and Disadvantages of Application of Various Refractory Materials for Cathodes*. Proceedings: Aluminum of Siberia. Krasnoyarsk, 2002, p. 14-24). However, the use of hot ramming paste is environmentally hazardous, and the transition to cold ramming paste and a decrease in cryolite ratio reduces the operation life of the cell.

A lining method is known (*Refractories for Cathodes of Electrolytic cells*/S. G. Sennikov et al. —Ogneupory I Technicheskaya Keramika, 2003, No. 10, p. 22-31), comprising filling the cell's cathode shell with powder material, leveling the material with a rack, sequentially laying of layers of polyethylene film, glass fiber laminate sheets or MDF on the fill material, and compacting the material by the dynamic method (using sleds with a vibrator.) However, when using such a device, both compaction and de-compaction of the mix occur at the same time; as a result, dusting of the material being compacted is observed.

A lining method is known, comprising filling the cell's cathode shell with powder material, leveling the material with a rack, wherein compaction is performed by compactors equipped with a vibratory mechanism (U.S. Pat. No. 4,184,787; E01C 19/38). This leads to a certain increase in packing density but the resulting barrier layer still has a relatively high porosity (up to 25%) and, moreover, it has wave-like defects on the surface.

A lining method is known, comprising filling the cell's cathode shell with powder material, leveling the material with a rack, wherein the process of compaction begins in a corner of the cathode shell, and is performed spirally (from the outside toward the center of the cathode.) When moving the vibrator, overlapping of the previously compacted area (by several centimeters) takes place. To finish the process of compacting barrier mixes, it is required to make several passes (trips) of the vibrator.

The main disadvantage of this method is multiple passes (trips) of the vibratory platform over the surface of the barrier material (due to a small size of the platform.) The parameters of the resulting barrier layer depend on the skills and scrupulosity of the operator. However, the most significant disadvantage is that the operation of the vibratory platform is primarily based on the dynamic method of formation (under non-optimum frequency and weight characteristics.) At a low bulk density of the lining material, it leads to that both compaction and de-compaction processes take place at the same time. As a result, dusting of the material being compacted is observed. The use of relatively thin glass fiber laminate sheets or MDF, not having sufficient hardness, results in an un-even surface; the surface of the barrier material after lining, as in the case of using vibratory compactors, is wave-like. Attempts to increase the hardness of the covering material lead to a decrease in the efficiency of the process of compaction (EP 1127983; E01C 19/38; E02D 3/046).

A method for forming seamless lining layers in electrolytic cells is known, comprising filling the cell's cathode shell with powder material, leveling the material with a rack, covering the fill material with dust-proof film, and compaction wherein material compaction is performed in two stages: preliminary static and final dynamic impact (compaction), by consequent movement of static and dynamic work tools of compaction along the longitudinal axis of the cathode of the electrolytic cell over the whole width of the lining layer being formed through a cushion; the dynamic material compaction is carried out by under-consonant-static-load vibratory units.

Based on its purpose and similar characteristics, this solution has been chosen as a prototype.

According to this solution, compaction is carried out in two stages: preliminary static and final dynamic impact (compaction), by consequent movement of static and dynamic work tools of compaction along the longitudinal axis of the cathode of the electrolytic cell over the whole width of the lining layer being formed through a cushion; the dynamic material compaction is carried out by under-consonant-static-load vibratory units.

This lining method does not meet the requirements regarding producing a high-quality, large depth and low bulk density barrier layer.

The technical device, through which the above lining process becomes possible, is an apparatus for forming seamless lining layers in electrolytic cells (RF Patent 2296819 Int. Cl. C25C 3/06, C25C 3/08, published in Bulletin of Inventions No. 10, 2007).

Based on its purpose and similar characteristics, this solution has been chosen as a prototype.

The apparatus for forming seamless lining layers in the electrolytic cell comprises a drive, a compacting device consisting of a unit for static treatment and a unit for dynamic treatment; the unit for static treatment is designed as a roller with a drive connected to the roller by means of a rocker arm and a pull-rod of the unit for dynamic treatment designed as a vibratory unit, including a vibratory exciter (with a directional driving force) mounted in a way so it is possible to move it around the horizontal axis of the roller.

The main disadvantage of the prototype apparatus is that the compacted material is pushed out right before the unit for static treatment, when forming a barrier layer of great depth and low bulk density. Moreover, the lack of such design elements that damp the horizontal component of vibration causes technical problems, when using, as a source of oscillations, vibratory exciters with a circular driving force or vibratory exciters with a directional driving force mounted on the vibratory unit at an acute angle to the treated surface (due to the transmission of vibration of the whole structure.) When using such oscillation sources, the electric motors of the unit for static treatment and other elements of the apparatus undergo vibration, which can lead to their failure, and, hence, reduce operational reliability.

SUMMARY OF THE INVENTION

The objective of the proposed technical solution is to reduce the apparent porosity of the lining layers produced from unshaped materials and increase the reliability of the apparatus.

The technical result of the invention is to slow down the rate of penetration of molten fluoride salts and aggressive gaseous components into the cathode thermal insulation through the barrier layer, and improve the cell performance (a decrease in power consumption for the production of 1 tonne of aluminum, and an increase in the operation life of the cell).

The task is performed as follows: a method for lining the cathode, which comprises filling the cell's shell with powder material, leveling it with a rack, covering the fill material with dust-proof film, and compaction performed in two stages: preliminary static and final dynamic impact (compaction), by consequent movement of static and dynamic work tools of compaction along the longitudinal axis of the cathode of the electrolytic cell through a cushion; the cushion is made of at least 2 layers: a lower layer, which prevents pushing powder material forward in the direction of travel, and an upper layer, which provides for a coupling between the cushion and the static work tool. Compaction is performed along the longitudinal sides of the cathode within a width of at least 0.5 of the width of the cathode; the hardness of the cushion varies in the range of 80 to 270 $Nm^2$, and the lower layer of the cushion uses thick steel plates (2.5 to 4)*10-4 in thickness, with a width of 0.12 to 0.15 and a length of 0.2 to 0.25 of the width of the layer being formed, wherein the steel plates are put edge-to-edge on the entire area being compacted along the long side of the cathode in 3-4 rows; and for a coupling between the cushion and the static work tool, rubber-fabric material (with a thickness of 2-3 of the thickness of the steel plate) is put as a top layer.

The task at hand is carried out as follows: an apparatus for performing the above method comprises a static treatment unit in the form of a roller with a drive, and a dynamic treatment unit with a vibratory exciter mounted thereon; the dynamic treatment unit is connected to the static treatment unit by means of elastic elements, providing for a simultaneous movement relative to both the horizontal and vertical axes of the roller.

The proposed apparatus is distinguished by several features helping perform the task.

The apparatus may be designed in such a way that the connection between the dynamic treatment unit and the static treatment unit may be done by means of elastic elements made of either rubber or metal springs. This prevents the transfer of vibration to the electric motor and other elements; in particular, to the metallic structure of the apparatus, when using, as a source of oscillations, vibratory exciters with a circular driving force or exciters with a directional driving force mounted on the vibratory unit at an acute angle to the treated surface, and, in general, increases reliability and durability of the device.

The comparative analysis of the features of the claimed solution and the features of the closest analogous solution and the prototype allows making a conclusion about compliance with criterion of "novelty".

The experience of using the said apparatus has demonstrated the following advantages:

- A wider range of materials can be used for lining cells (due to the ability of making layers of bigger size during compaction); and
- A higher degree of compaction of the upper layers of the lining material.

Achieving the above becomes possible only thanks to the above relationship between the method parameters and the design elements of the apparatus. Comparison of the claimed solution not only to the prototype but also to other technical solutions in this art has allowed identifying the features in them which distinguish the claimed solution from the prototype, which makes it possible to conclude that it meets the criterion of "inventive step".

DETAILED DESCRIPTION OF THE INVENTION

Figure 1:
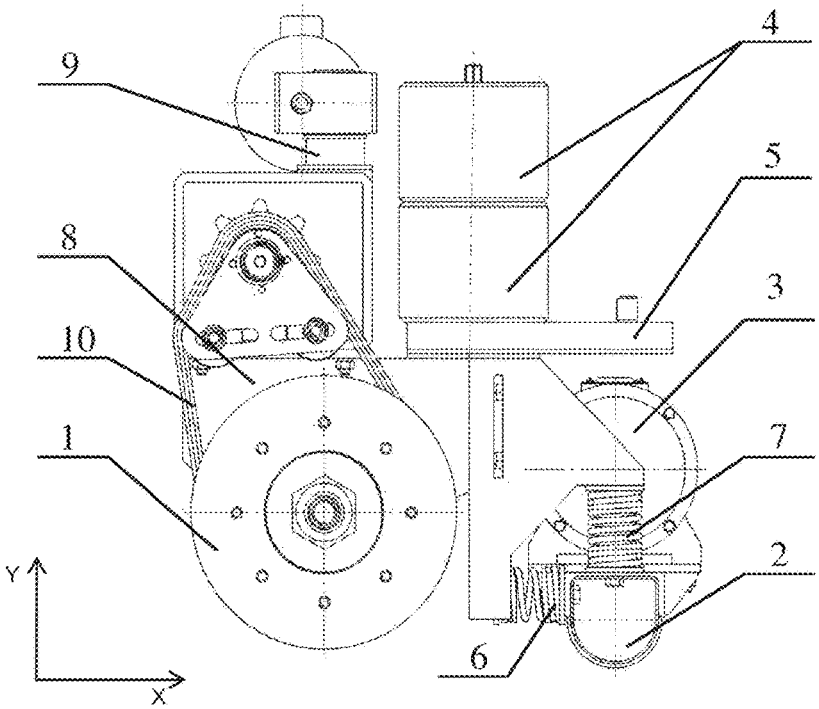
FIG. 1 shows the vibrating compaction tool (VCT) for molding seamless lining layers in aluminum pots (side view) with flexible elements made of metal springs.
Figure 2:
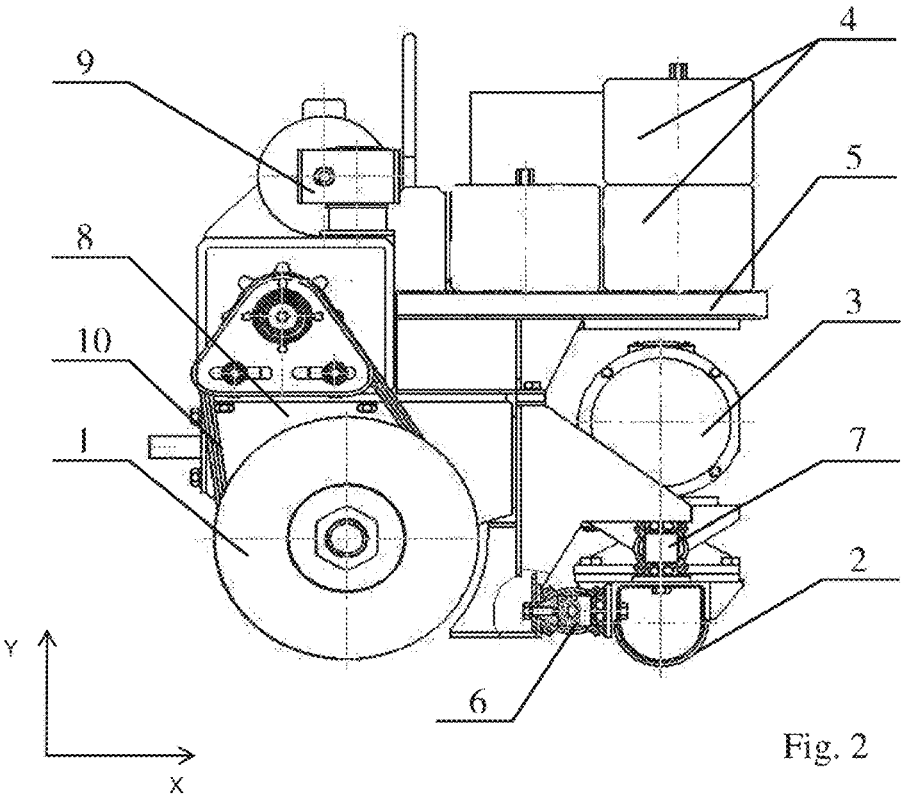
FIG. 2 shows the VCT with flexible elements made of rubber.

The essence of this technical solution is illustrated by an example of specific design and drawings. FIG. 1 shows an apparatus for forming seamless lining layers in electrolytic cells (side view) with elastic elements made of metal springs; and FIG. 2 shows an apparatus for forming seamless lining layers in electrolytic cells (side view) with elastic elements made of rubber.

The apparatus for forming seamless lining layers in electrolytic cells consists of driving disks 1, which form a drive unit for static compaction (in the form of a roller), vibratory unit 2 with vibrator 3, weights 4 located on load platform 5, which is connected to vibratory unit 2 by means of elastic elements 6 and 7 (made of metal springs in FIG. 1 and rubber in FIG. 2), 5 which combine the vibratory unit and the static treatment unit into a compaction device by means of rocker arm 8, including the ability to freely move the vibratory unit along the horizontal (X) and vertical (Y) axes (anchor) of the roller. The drive of the apparatus for forming seamless lining layers in electrolytic cells consists of gear motor 9, and chain gear 10. Gear motor 9 is mounted on rocker arm 8, to which load platform 5 is also mounted.

The technical essence of the claimed solution is as follows:

Gear motor 9 and vibrators 3 are started from the control panel. Rotation of gear motor 9 via chain gear 10 is transmitted to driving disks 1 of the roller. Driving discs 1, when rotate, move the apparatus over the surface of the cushion put on the treated material. Preliminary static compaction of unshaped lining materials is performed. Final compaction occurs due to an impact (on the material being treated) from vibratory unit 2, moving along the horizontal (X) and vertical (Y) axes of the roller and loaded with weights 4 via elastic element units.

Figure 3:
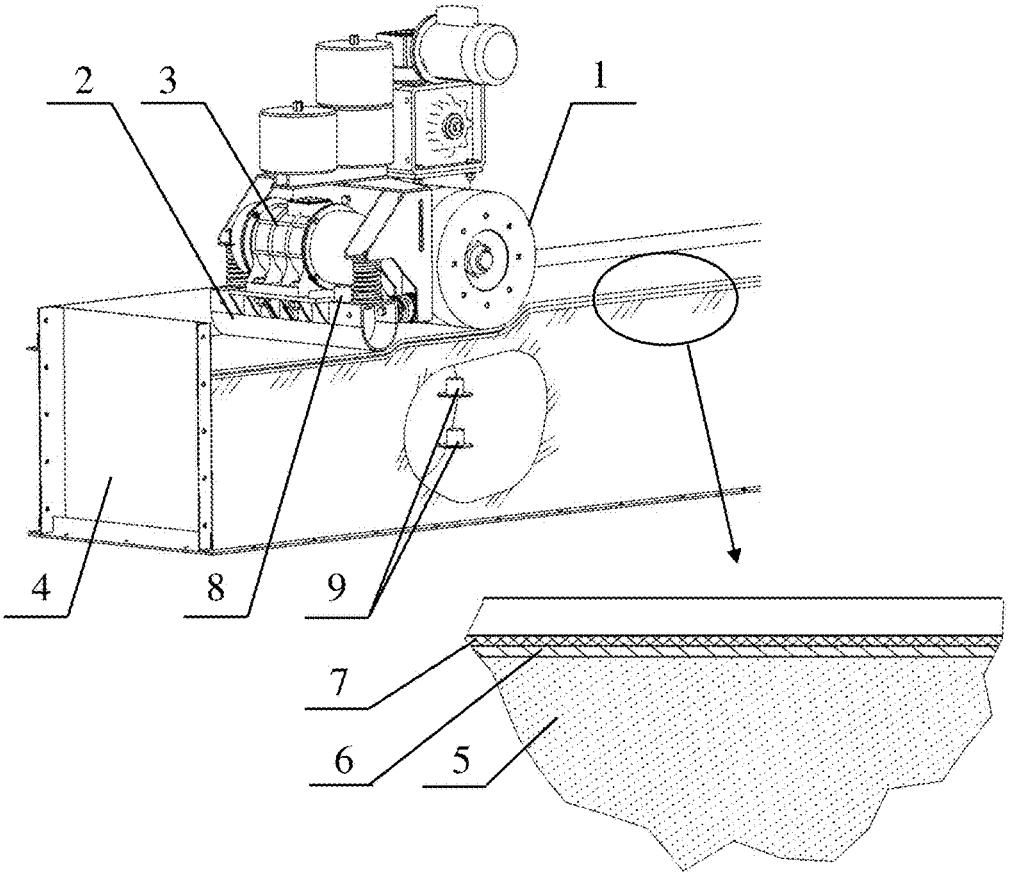
FIG. 3 shows a diagram of a stand for determining the optimal design and process parameters of the VCT.

For determining the optimum design and process parameters of the Vibratory Compaction Unit (VCU), experimental studies of the process of compacting fine (granular) material were carried out on the bench shown in FIG. 3. The bench includes a container with granular material and a local VCU, allowing providing deformation of granular media by static loads together with vibration loads of different frequency and intensity.

When moving the VCU within the container with material, the VCU creates a preliminary static load by rollers 1, which are also a moving mechanism, and a dynamic load is created by vibratory unit 2, the amplitude versus frequency response characteristics of which are set by exciter 3. As a source of oscillations, the exciter with a directional or circular driving force is used. The VCU was placed in container 4 filled with granular material 5; the filling height (innage) was 300 to 500 mm.

The material was compacted through a cushion, consisting of metal plate 6 (FIG. 3) 2 mm in thickness and rubber plate 7 (5 mm thick.)

During compaction, the cushion prevented material push-outs from under the rollers, helped reduce the content of dust in the air and kept the VCU on the surface of the material (when a layer of material under compaction was of great thickness.) There are two possible ways of loading (compacting): the first one is static (the vibratory unit is off), the second one is combined (both static and dynamic). Under combined impact (compaction) conditions, the material, located between the roller and the vibratory unit, is closed within a limited volume. Pushing-out of the material from the side of the vibratory unit is prevented by finally compacted material; from the side of the roller—by preliminary compacted material, from above—by the cushion.

Vibratory acceleration in the material and at the vibratory unit was registered by piezosensors 8 and 9 (FIG. 3), which allowed simultaneous monitoring of the horizontal and vertical components of the oscillations. The signal from the sensor was amplified, integrated and transferred to a personal computer.

The density of the layers of the compacted material was determined by a static densitometer B-1, and the density of the obtained compacted material was characterized by the dynamic modulus of elasticity as measured by a portable HMP LFG deflectometer (FIG. 3).

Information collection and measuring result processing were carried out by using ACTest®—a software system for automation of experimental and process units.

Figure 4:
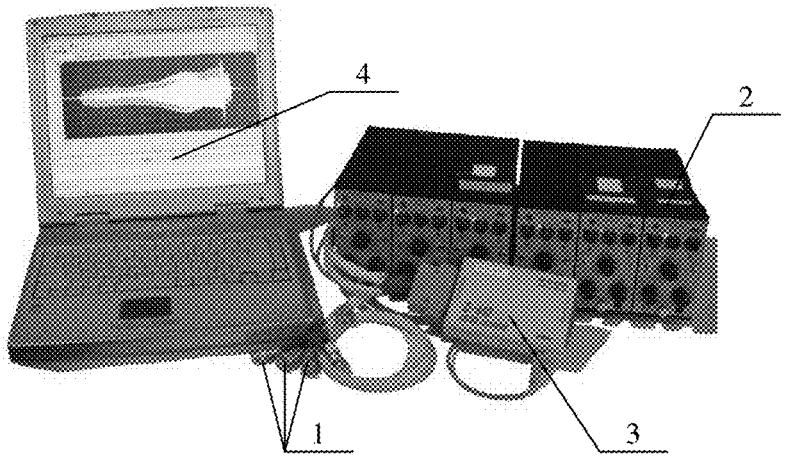
FIG. 4 shows an image of a six-channel measuring unit for determining the optimal parameters of the VCT.

For experiments, a six-channel measurement system was used (FIG. 4), including the following devices:

- Piezoelectric accelerometers (Brüel & Kjær, Denmark);
- Charge amplifiers Type 2635 (Brüel & Kjær, Denmark);
- Analog-to-digital converter E-440 (CJSC L-Card, Russia); and
- Personal computer.

Figure 5:
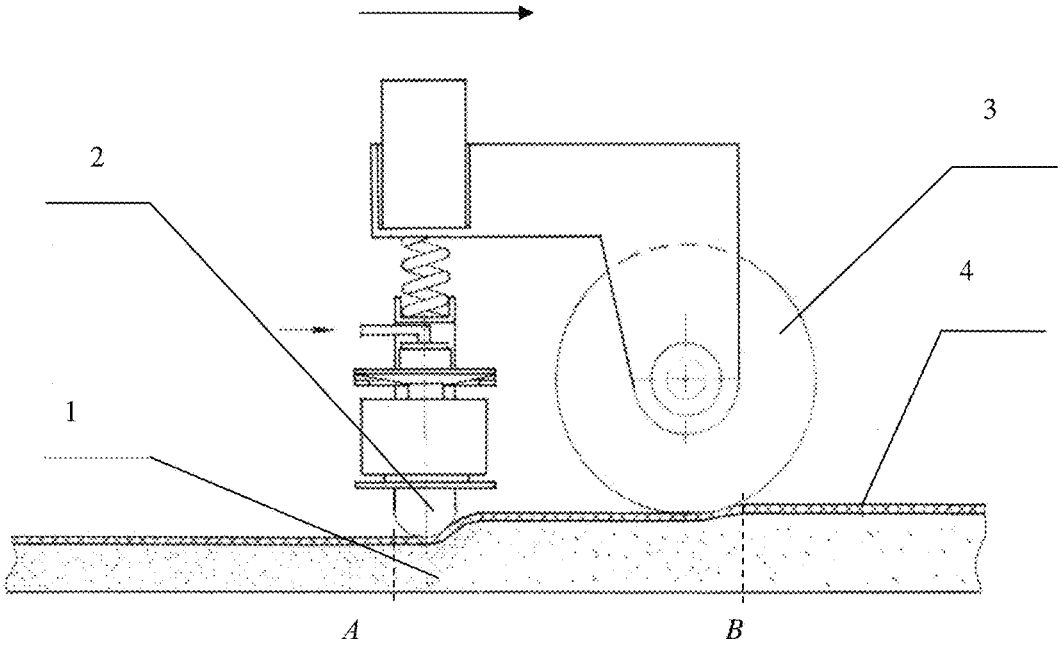
FIG. 5 shows a graph of dynamic modulus of elasticity of the compressed material versus machining time at various vibration generator amplitude frequency responses.

After starting, the VCU moves along the container filled with fine (granular) material (FIG. 5). Either only a static impact on the material (if the vibratory block is off) or a combined impact (static and dynamic loads) is possible. Static compaction is of no particular interest, as it is no different from conventional rolling (compaction). In the second case, at a fixed point of time, a portion of preliminary compacted material 1 located between vibratory unit 2 and roller 3 (FIG. 5, the boundaries are marked by letters A and B) becomes closed within a limited volume. Its displacement (push-out) is prevented by already compacted material, from one side; by the pressure created by the roller, from the other side; and by plate 4, from above. Directly under the vibratory unit, a compression wave occurs and deforms the material, while some of the material is squeezed out into the closed area, which puts pressure on bulky (granular) mass in the area. Moreover, under the influence of vibration and rheological effects related thereto, a relative motion of material particles occurs in this area (particles tend to form a denser structure), as well as air and moisture are displaced, i.e. preliminary dynamic compaction is carried out. The process of deformation of the material is completed after a direct impact of compressive loads (generated by the vibratory unit) on the material.

For determining the optimum parameters (during the experimental studies), the amplitude vs. frequency response characteristics of the exciter, the velocity of movement (travel), the static load were adjusted.

Figure 6:
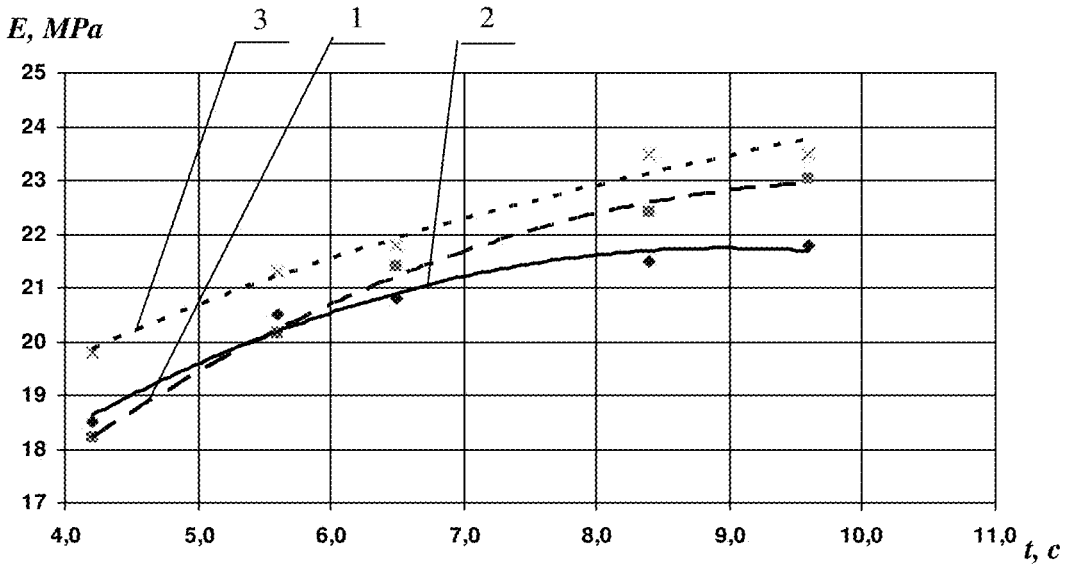
FIG. 6 shows a graph of dynamic modulus of elasticity of the compressed material versus force acting on the system.

The results of the experimental studies are presented in FIG. 6 in the form of graphs. The process of compacting fine (granular) material, within a closed volume (area), takes place most efficiently in the frequency range of 45-60 Hz; under the same treatment time, an increase in the frequency from 35 to 60 Hz can lead to an increase in the density by 5 to 10%; a further increase in frequency causes no noticeable change in packing density. An increase in the treatment time, under constant vibration parameters (acceleration and frequency), leads to an increase in density, wherein quite a dense packing is formed within the first 6 to 7 seconds; further loading leads to a further increase in density but at a substantially lower rate.

Figure 7:
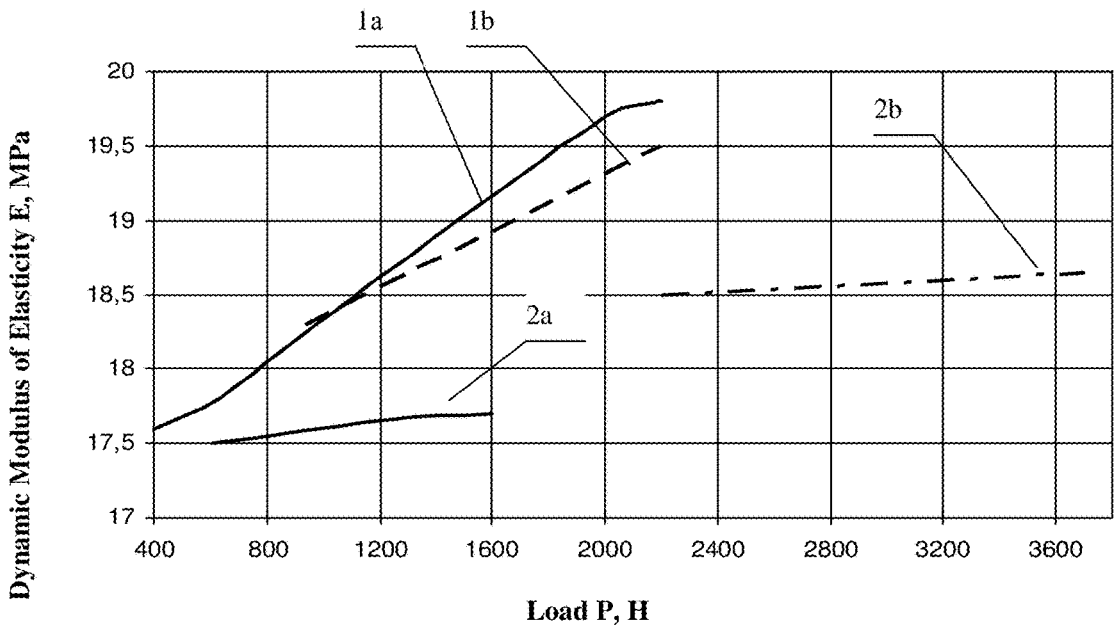
FIG. 7 shows dynamic modulus of elasticity relative to acceleration versus static load.

It was found out that with an increase in the vibratory impact frequency, the dynamic modulus of elasticity of the material being compacted changes more rapidly than if there is an increase in the vibratory impact due to the amplitude of oscillations, which is confirmed by the results of the experiments shown in FIG. 7. Curves 1*a* and 1*b* represent the dependence of the modulus of elasticity of the material being compacted on the value of the force affecting the system that changes depending on the frequency under a constant (static) torque; curves 2*a* and 2*b* correspond to modulus vs. value of the force relationships (the force that changes depending on the static torque under a constant frequency).

It was experimentally determined that the density of fine (granular) material, during vibratory compaction, was mainly influenced by the acceleration of oscillations transmitted to the granular medium; and with an increase in the vibratory impact frequency, the dynamic modulus of elasticity of the material being compacted changes more rapidly than if there is an increase in the vibratory impact due to the amplitude of oscillations (FIG. 7). At a frequency below 35 Hz, the efficiency of the vibratory impact significantly reduces.

Figure 8:
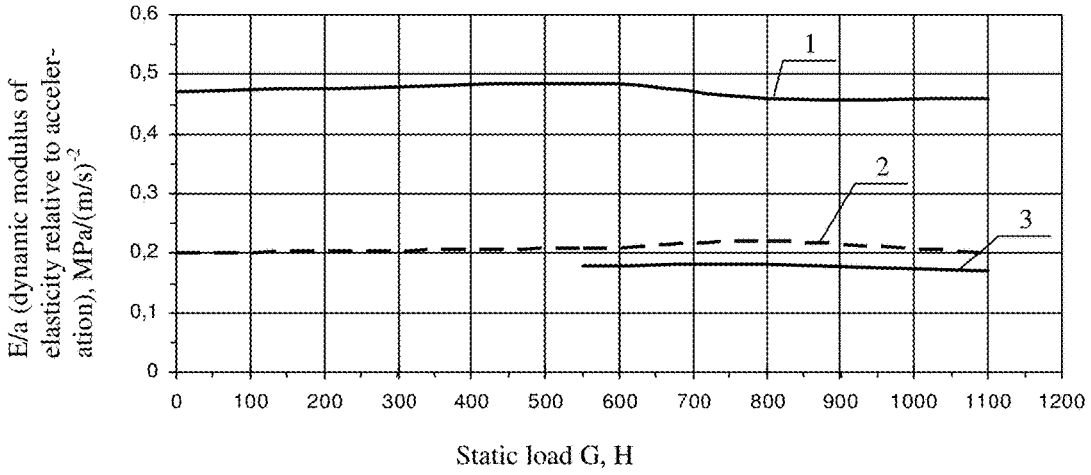
FIG. 8 shows a graph of vibration velocity versus depth in the compressed material.

The experiments showed that the static load did not significantly influence the dynamic modulus of elasticity of the packing. However, the static load, being part of the oscillatory system, effects only the dynamic parameters of the system. FIG. 8 shows dynamic modulus of elasticity relative to acceleration vs. static load value.

Figure 9:
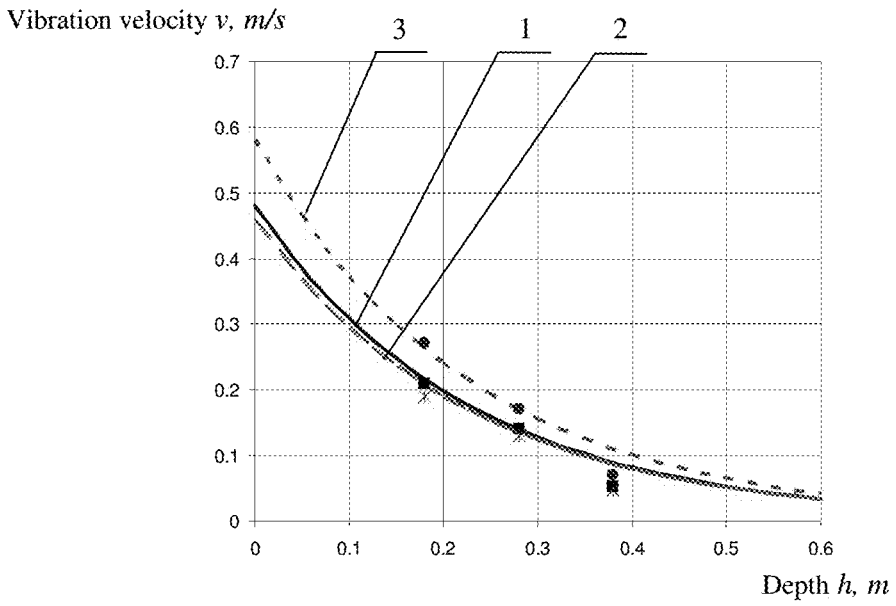
FIG. 9 shows the results of measuring the vibration velocity along the depth of the mass of the material being compacted.

FIG. 9 shows the results of measuring the vibration velocity along the depth of the mass of the material being compacted. The origin of coordinates is combined with the daylight surface of the material being compacted. The curves (relationships) shown in FIG. 3 correspond to oscillation frequencies of 25 Hz, 34 Hz and 49.6 Hz (curves 1, 2 and 3, respectively). Markers ■, ✕ and ● are used for the points obtained experimentally; they correspond to oscillation frequencies of 25 Hz, 34 Hz and 49.6 Hz.

It was determined that, within the considered (above) frequency range, the attenuation of vibration in the compacted mass was exponential:

$$v=v_0 \cdot e^{-\lambda \cdot h},$$

where $v_0$—vibration velocity at the vibratory unit (at the daylight surface of the material being compacted), m/s; v—vibration velocity of the material being compacted at a depth of h, m/s; λ—attenuation coefficient, determined experimentally (λ=4.4); h—distance from the daylight surface to the compacted layer of the material, m.

For this material (dry barrier mix) within the range of 25 to 50 Hz, the vibratory impact frequency does not substantially affect the density of the material along the depth for this frequency range.

The highest density of the material is found to be in the upper layers of the compacted mass—up to the depth of penetration (the depth at which the oscillations are damped by e times), which amounted to 230 mm, at greater depths the packing density decreases (due to a decrease in the intensity of vibration caused by the damping of the oscillations.)

Despite a decrease in the vibration velocity in the lower layers, their density decreases insignificantly with an increase in depth (by 5 to 10%), when compacting the material with the same granulometry, and physical and mechanical properties.

The use of the above cathode lining will help have a total cost benefit, in terms of one electrolytic cell, of not less than USD 2,000 per year (by means of reducing the cost of lining materials and reducing labor costs during lining.)

What is claimed is:

1. An apparatus for forming seamless lining layers in electrolytic cells comprising:

a static treatment unit comprising a roller and a drive and a dynamic treatment unit with a vibratory exciter mounted thereon, wherein the dynamic treatment unit is connected to the static treatment unit by a plurality of elastic elements, the plurality of elastic elements comprising at least one vertical elastic element and at least one horizontal elastic element, providing for a simultaneous movement of the dynamic treatment unit relative to both the horizontal and vertical axes of the roller, such that vibration from the vibratory exciter to the static treatment unit is dampened in both the vertical and horizontal directions by the plurality of elastic elements.

2. The apparatus of claim 1, wherein the plurality of elastic elements comprise rubber.

3. The apparatus of claim 1, wherein the plurality of elastic elements comprise metal springs.

4. The apparatus of claim 1, wherein the dynamic treatment unit is connected to the static treatment unit by a plurality of vertical elastic elements and a plurality of horizontal elastic elements.

5. The apparatus of claim 1, wherein the static treatment unit further comprises a load platform and weights located on the load platform.

6. The apparatus of claim 1, wherein the drive comprises a gear motor and a chain gear, the chain gear in connection with the roller, whereby rotation of the gear motor is transmitted to the roller via the chain gear.

7. The apparatus of claim 1, wherein the dynamic treatment unit further comprises one or more piezoelectric sensors to monitor vibratory acceleration of the dynamic treatment unit.

8. The apparatus of claim 1, wherein the dynamic treatment unit further comprises a rocker arm in connection with the plurality of elastic elements.

9. The apparatus of claim 1, wherein the vibratory exciter exhibits a circular driving force.

10. The apparatus of claim 1, wherein the vibratory exciter exhibits a linear driving force and is mounted on the dynamic treatment unit at an acute angle to the treated surface.

* * * * *